US006505755B1

(12) United States Patent
Voss

(10) Patent No.: US 6,505,755 B1
(45) Date of Patent: Jan. 14, 2003

(54) DEVICE FOR WITHDRAWING BANK NOTE BUNDLES AND MAKING THEM AVAILABLE AT A CASH WITHDRAWAL STATION

(75) Inventor: Hans Günter Voss, Paderborn (DE)

(73) Assignee: Wincor Nixdorf GmbH & Co. KG, Paderborn (DE)

( * ) Notice: Subject to any disclaimer, the term of this patent is extended or adjusted under 35 U.S.C. 154(b) by 0 days.

(21) Appl. No.: 09/622,192

(22) PCT Filed: Jan. 11, 1999

(86) PCT No.: PCT/DE99/00028

§ 371 (c)(1),
(2), (4) Date: Aug. 11, 2000

(87) PCT Pub. No.: WO99/41711

PCT Pub. Date: Aug. 19, 1999

(30) Foreign Application Priority Data

Feb. 13, 1998 (DE) ..... 198 06 029

(51) Int. Cl.[7] ..... B65H 3/00; G07F 11/00

(52) U.S. Cl. ..... 221/192; 221/130; 221/84; 209/534

(58) Field of Search ..... 221/192, 130, 221/84; 209/534

(56) References Cited

U.S. PATENT DOCUMENTS

| | | | | | |
|---|---|---|---|---|---|
| 3,193,138 | A | * | 7/1965 | Cox et al. | 221/192 |
| 3,851,744 | A | * | 12/1974 | Erickson | 194/4 |
| 4,017,004 | A | * | 4/1977 | Onoe et al. | 221/94 |
| 4,108,333 | A | * | 8/1978 | Falk et al. | 221/13 |
| 4,252,251 | A | * | 2/1981 | Elk et al. | 221/227 |
| 4,337,864 | A | * | 7/1982 | McLean | 209/534 |
| 4,339,221 | A | * | 7/1982 | Mitzel et al. | 414/114 |
| 4,430,562 | A | * | 2/1984 | Lundblad | 235/379 |
| 4,447,714 | A | * | 5/1984 | Landblad | 235/379 |
| 4,560,088 | A | * | 12/1985 | Tan | 221/75 |
| 4,655,368 | A | * | 4/1987 | Bateman et al. | 221/4 |
| 4,745,266 | A | * | 5/1988 | Miura | 235/379 |
| 4,997,128 | A | * | 3/1991 | Suris | 232/16 |
| 5,076,441 | A | * | 12/1991 | Gerlier | 209/534 |
| 5,522,511 | A | * | 6/1996 | Sakaguchi et al. | 209/534 |
| 5,649,641 | A | * | 7/1997 | Campoli | 221/197 |
| 5,791,512 | A | * | 8/1998 | Kanatsuka | 221/2 |
| 5,996,838 | A | * | 12/1999 | Bayer et al. | 221/75 |
| 6,003,652 | A | * | 12/1999 | Murata et al. | 194/206 |
| 6,006,989 | A | * | 12/1999 | Ademmer et al. | 235/379 |
| 6,203,000 | B1 | * | 3/2001 | Hill | 270/58.11 |
| 6,213,310 | B1 | * | 4/2001 | Wennersten et al. | 209/534 |

FOREIGN PATENT DOCUMENTS

| | | | | |
|---|---|---|---|---|
| DE | 36 32 108 A1 | | 4/1987 | |
| EP | 0 182 137 | | 5/1986 | |
| EP | 0604880 A2 | * | 7/1994 | G07D/13/00 |
| JP | 1-253093 | * | 10/1989 | G07F/11/58 |

OTHER PUBLICATIONS

"Transport Mechanism for Cash Dispenser", C. J. Roach, IBM Technical Disclosure Bulletin, vol. 18, No. 8, Jan. 1976, pp. 2652–2653 (XP–002057669).

* cited by examiner

*Primary Examiner*—Donald P. Walsh
*Assistant Examiner*—Michael E. Butler
(74) *Attorney, Agent, or Firm*—McCormick, Paulding & Huber LLP

(57) ABSTRACT

An apparatus for removing banknote bundles from a multiplicity of banknote magazines (12, 14, 16), which are arranged one above the other in a housing (10) and are equipped with a separating device, and for supplying the banknote bundles at an outlet opening (32), comprises a lift (19) with a receiving container (28) for banknote bundles. The separating arrangement and the lift (19) are driven independently of one another. The receiving container (28) has a single receiving position (29) which is common to all the banknote magazines (12, 14, 16) and is located beneath the lowermost banknote magazine (16), in front of the discharge opening (18) of the same.

4 Claims, 1 Drawing Sheet

Figure 1:
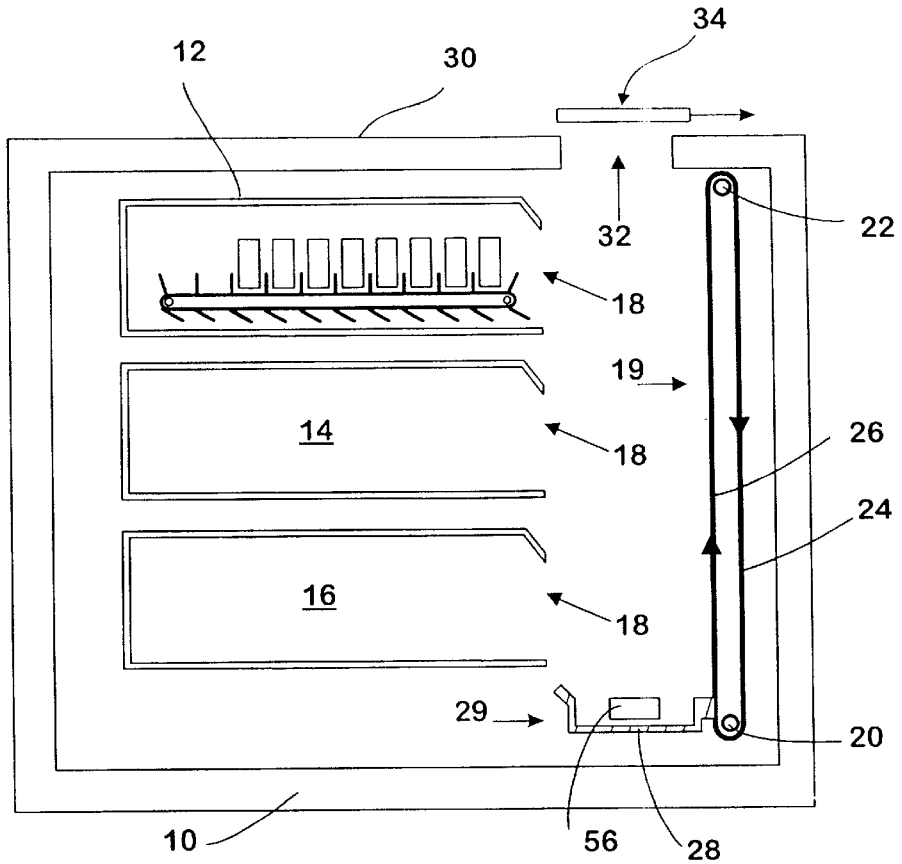

DEVICE FOR WITHDRAWING BANK NOTE BUNDLES AND MAKING THEM AVAILABLE AT A CASH WITHDRAWAL STATION

The invention relates to an apparatus for removing banknote bundles from a multiplicity of banknote magazines, which interact with a separating device and are arranged one above the other in a housing, and for supplying the banknote bundles at an outlet opening, comprising a lift with a receiving container for banknote bundles, which can be moved vertically between a receiving position, which is located beneath a banknote magazine, and a supplying position, which is located in the vicinity of the outlet opening.

An apparatus of the abovementioned type with a plurality of banknote containers is known from German Laid-Open Application DE 36 32 108 A1. In this document, there is arranged, in front of each banknote container, a separating device for banknote bundles which are positioned one behind the other in vertical alignment in the banknote container. Acting on the rear side of the stacks of banknote bundles is a pressure-exerting device, which prestresses the stack of banknote bundles in the direction of the separating device. The separating device comprises a transfer element which, for bundle-removal purposes, acts on the underside of the foremost banknote bundle and raises the same until, under the action of the pressure-exerting device, it tips over the front wall of the banknote container and, in its tipped position, comes to rest on a bundle support. Thereupon, the bundle support is lowered, by virtue of the lift being moved downward, until the banknote bundle, on a sloping plane, slides into the receiving container. The lift then moves in the opposite direction to the next banknote container. The abovedescribed operation is repeated from bottom to top for each banknote container until the lift has reached the supplying position.

The known arrangement is of extremely complex design. Added to this is the fact that the lift, for each removal operation, has to be moved in a first direction, moved back and then moved in the first direction again. This results in constantly alternating positive and negative acceleration operations, which has an adverse effect on the operating speed of the arrangement. The operating speed is also adversely affected by the fact that banknote bundles can only be removed one after the other from the various banknote containers.

The object of the invention is thus to propose an apparatus for removing banknote bundles from a multiplicity of banknote magazines which is a straightforward construction and manages with a small number of different movement operations.

The object is achieved by the features of claim 1.

The separating arrangement and the lift are driven independently of one another and the receiving container of the lift has only a single receiving position for all the banknote magazines located one above the other, said receiving position being located beneath the lowermost banknote magazine, in front of the same. A banknote bundle may be separated from a banknote magazine at any desired point in time, and then free falls into the receiving container. Ignoring the different falling speeds, which are attributable, in particular, to the different air resistances of individual banknote bundles, it is possible in this case for all the banknote magazines to discharge a banknote bundle at the same time. On account of the different falling heights, said banknote bundles will arrive in the receiving container one after the other. In practice, it is sufficient to begin at the lowermost banknote magazine and to provide, from bottom to top in each case, a small time difference between the separating operations of the banknote magazines arranged one above the other. This means that, despite the great likelihood of collision of the individual banknote bundles, a high operating speed is ensured as the various banknote bundles are collated. Following the collation, the lift transports the receiving container into the supplying position.

There are thus only two positions necessary for the lift: a receiving position, beneath the lowermost banknote magazine, and the supplying position. The control of the lift as far as the precise positioning of the receiving container is concerned thus likewise requires only a low level of outlay.

According to a first embodiment of the invention, the banknote magazine has an endless belt stretched horizontally over rollers, at least one of the rollers being in drive connection with a motor. Arranged at a spacing, corresponding at least to the thickness of a banknote bundle, on the endless belt are bars which project from the outside of said belt and are aligned in the direction normal to the movement direction of the endless belt, and the discharge opening of the banknote magazine is located in the vicinity of one of the rollers.

During filling of the banknote magazine, the banknote bundles, at least on the top strand of the endless belt, are fitted in each case into a chamber formed between two adjacent bars. For the purpose of discharging a banknote bundle, the endless belt is driven such that its top strand moves in the direction of the discharge opening. In this case, the bar closest to the discharge opening pivots about the front roller, the chamber between said bar and the following bar spreads open and the banknote bundle slides from the endless belt via the now downwardly inclined, front bar. A control device ensures that, during each discharge operation, the endless belt only advances by the width of one chamber.

According to a second embodiment of the invention, the banknote magazine has a transporting worm, of which one end is the discharge opening of the banknote magazine and the other end is mounted rotatably and in drive connection with a motor. The interspace between adjacent worm helices serves here as a receiving space for a banknote bundle.

For the purpose of discharging a banknote bundle, the transporting worm is rotated in the direction of the discharge opening. In this case, the banknote bundles mounted between the worm helices move in the direction of the discharge opening until the foremost banknote bundle falls out of the transporting worm. A control device ensures that, during each discharge operation, the transporting worm only executes one revolution.

Figure 2:
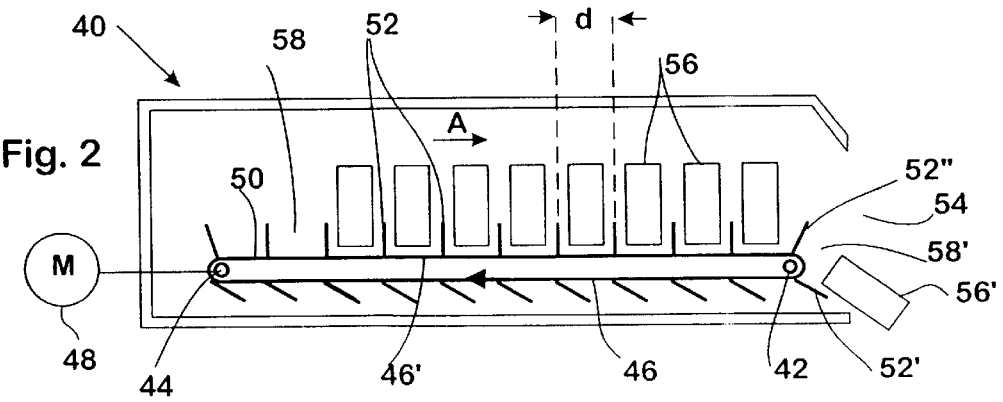
Figure 3:
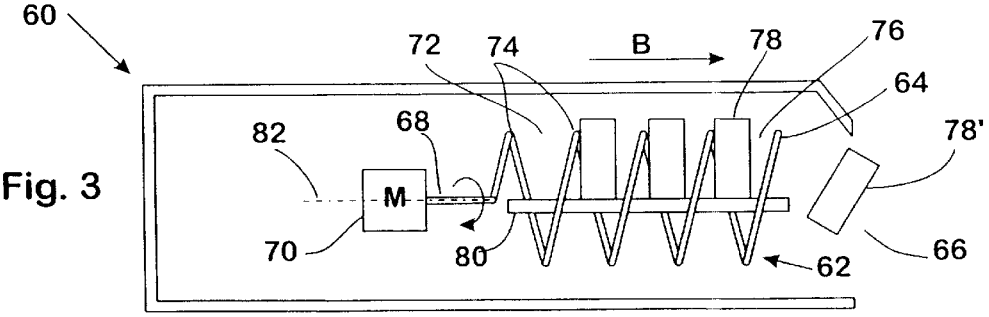

The invention is explained in the following description with reference to exemplary embodiments in conjunction with the attached drawings, in which:

FIG. 1 shows a schematic side view of an apparatus for storing and removing banknote bundles using a plurality of banknote magazines, and for supplying banknote bundles at an outlet opening, FIG. 2 shows a banknote magazine according to a first exemplary embodiment, and FIG. 3 shows a banknote magazine according to a second exemplary embodiment.

FIG. 1 shows a schematic side view of an apparatus for storing and removing banknote bundles using a plurality of banknote magazines, and for supplying banknote bundles at an outlet opening. Said apparatus comprises a safe 10 in which three banknote magazines 12, 14, 16 are arranged one above the other. The latter each have a discharge opening 18, which is directed toward a lift 19. The lift 19 essentially comprises two parallel, endless transporting belts 24 (only one can be seen) stretched vertically between two belt rollers 20, 22, a receiving container 28 which is open in the upward direction being fastened on the strand 26 of the transporting belts, said strand being directed toward the banknote magazines 12, 14, 16. An outlet opening 32 is provided above the receiving container 28, in the cover panel 30 of the safe 10. A closure plate 34 which covers said opening can be displaced between a position in which it closes off the outlet opening 32 and a position in which it releases the same.

FIG. 2 designates with 40 a banknote magazine which is configured according to a first exemplary embodiment. This banknote magazine has an endless belt 46 stretched horizontally over rollers 42, 44. The roller 44 is in drive connection with a motor 48. Arranged at a spacing d on the endless belt 46 are bars 52 which project from the outside 50 of said belt and are aligned in the direction normal to the movement direction A of the endless belt 46. The discharge opening 54 of the banknote magazine 40 is located in the vicinity of the front roller 42.

During filling of the banknote magazine 40, in each case one banknote bundle 56 is fitted into a chamber 58 formed between two adjacent bars 52 on the top strand 46' of the endless belt 46. For the purpose of discharging a banknote bundle 56', the endless belt 46 is driven in the direction of the arrow A, with the result that its top strand 46' moves in the direction of the discharge opening 54. In this case, the bar 52', closest to the discharge opening 54, pivots about the front roller 42, the chamber 58' between said bar and the following bar 52" spreads open and the foremost banknote bundle 56' slides from the endless belt 46 via the now downwardly inclined, front bar 52'. A control device (not illustrated) ensures that, during each discharge operation, the endless belt 46 only advances by the width d of one chamber 58.

FIG. 3 designates with 60 a banknote magazine which is configured according to a second exemplary embodiment. This banknote magazine has a transporting worm 62, of which the front end 64 is located in the vicinity of the discharge opening 66 of the banknote magazine 60 and the other end 68 is mounted rotatably and in drive connection with a motor 70. The interspaces 72 between adjacent worm helices 74 each form a receiving space 76 for a banknote bundle 78. Said banknote bundles in this case have their underside positioned on a horizontal plate 80 through which the longitudinal axis 82 of the transporting worm 62 runs.

For the purpose of discharging a banknote bundle 78, the transporting worm 62 is rotated in the direction of the arrow B. In this case, the banknote bundles 78 mounted between the worm helices 74 move in the direction of the discharge opening 66 until the foremost banknote bundle 78' falls out of the transporting worm 62, and thus from the plate 80. A control device (not illustrated) ensures that, during each discharge operation, the transporting worm 62 only executes one revolution.

In the apparatus according to the invention, it is also possible to use banknote magazines other than those shown by way of example in FIGS. 2 and 3. It is also possible to use a so-called winding store in the case of which a multiplicity of banknote bundles are retained between the windings of a band wound up onto a drum. For the purpose of discharging a banknote bundle, the band is unwound from the drum until such time as the banknote bundle is released. A winding store for individual banknotes is known, for example, from DE 197 06 131 A1, so we shall dispense with a detailed description.

In the simplest case, a banknote bundle comprises a number of banknotes located loosely one upon the other. However, these banknotes may also be held together by a band or deposited in an envelope.

I claim:

1. An apparatus for removing banknote bundles each consisting of a number of banknotes, from a multiplicity of banknote bundle magazines and for supplying the banknote bundles at an outlet opening of the housing, said apparatus, comprising a housing (10) having an outlet opening (32), a multiplicity of banknote bundle magazines (12, 14, 16; 40, 60) each for holding a plurality of banknote bundles (50; 78), the magazines being arranged one above the other in the housing and each magazine including a motor driven separating device (46, 48; 62, 70) holding banknote bundles separate from one another in the magazine by portions of the separating device located between adjacent ones of the banknote bundles in the magazines and operable to move the banknote bundles of the magazine in succession to a discharge opening (18; 54, 60) of the magazine and to drop the banknote bundles in succession from the discharge opening, a motor driven lift (19) with a receiving container (28) for banknote bundles (56, 78), which can be moved vertically between a receiving position (29), and a supplying position, located in the vicinity of the outlet opening (32), the separating devices (46, 48, 62, 70) of the magazines and the lift (19) being driven independently of one another, and the receiving position of the receiving container (28) of the lift (19) being a single position located beneath the lowermost banknote bundle magazine (16), in front of the discharge opening (18) of the same, so that the receiving container (28) when in the receiving position receives a bank note bundle dropped from the discharge opening of any one of the magazines.

2. The apparatus as claimed in claim 1, wherein:

said motor driven separating device of at least one of said banknote bundle magazines includes an endless belt (46) stretched horizontally over rollers (42, 44), at least one of the rollers (44) being in drive connection with a motor (48), and arranged at a spacing (d) on the endless belt (46) are bars (52) which project from the outside (50) of said belt and are aligned in the direction normal to a movement direction (A) of the endless belt (46), and in that the discharge opening (54) of the banknote magazine (40) is located in the vicinity of one of the rollers (42).

3. The apparatus as claimed in claim 1, wherein:

said motor driven separating device of at least one of said banknote bundle magazines includes a transporting worm (62), of which one end (64) is located in the vicinity of the discharge opening (66) of the banknote bundle magazine (60) and the other end (68) is mounted rotatably and in drive connection with a motor (70), an interspace (72) between adjacent worm helices (74) being a receiving space (76) for a banknote bundle (78).

4. The apparatus as claimed in claim 1, wherein:

at least one of said banknote bundle magazines is a winding store.

* * * * *